US008801527B2

(12) United States Patent
Larson

(10) Patent No.: US 8,801,527 B2
(45) Date of Patent: Aug. 12, 2014

(54) POOL CUE

(71) Applicant: Mark Larson, Verona, WI (US)

(72) Inventor: Mark Larson, Verona, WI (US)

( * ) Notice: Subject to any disclaimer, the term of this patent is extended or adjusted under 35 U.S.C. 154(b) by 93 days.

(21) Appl. No.: 13/719,951

(22) Filed: Dec. 19, 2012

(65) Prior Publication Data

US 2013/0165244 A1 Jun. 27, 2013

Related U.S. Application Data

(60) Provisional application No. 61/578,659, filed on Dec. 21, 2011, provisional application No. 61/658,488, filed on Jun. 12, 2012.

(51) Int. Cl.
*A63D 15/08* (2006.01)

(52) U.S. Cl.
CPC ..... *A63D 15/08* (2013.01)
USPC ..... 473/44

(58) Field of Classification Search
USPC ..... 473/44–51
See application file for complete search history.

(56) References Cited

U.S. PATENT DOCUMENTS

| | | | | | |
|---|---|---|---|---|---|
| 941,728 | A | * | 11/1909 | Preast | 473/44 |
| 951,453 | A | | 3/1910 | Ransom | |
| 1,241,194 | A | * | 9/1917 | Carlson et al. | 473/44 |
| 1,248,634 | A | | 12/1917 | Du Bose | |
| D52,945 | S | | 2/1919 | Carlson et al. | |
| 1,552,442 | A | | 9/1925 | Lund | |
| 3,692,609 | A | * | 9/1972 | Eckes | 264/138 |
| 5,114,144 | A | | 5/1992 | Baum | |
| 5,217,221 | A | | 6/1993 | Baum | |
| D371,819 | S | | 7/1996 | Brown | |
| 6,869,370 | B2 | | 3/2005 | Davtyan et al. | |
| D556,276 | S | | 11/2007 | Stoller | |
| 7,294,061 | B2 | | 11/2007 | Kwon | |
| D583,430 | S | | 12/2008 | Belhaj et al. | |
| 7,485,054 | B2 | | 2/2009 | Rigoli | |
| 7,614,969 | B2 | | 11/2009 | Meyer | |
| D673,628 | S | | 1/2013 | Larson | |
| D674,033 | S | | 1/2013 | Larson | |
| 2002/0072423 | A1 | * | 6/2002 | Pot | 473/44 |
| 2004/0009822 | A1 | * | 1/2004 | McCarty | 473/44 |
| 2004/0116196 | A1 | | 6/2004 | Nazaruk | |
| 2004/0224781 | A1 | * | 11/2004 | Davtyan et al. | 473/44 |
| 2006/0030418 | A1 | * | 2/2006 | Evans et al. | 473/44 |
| 2007/0010340 | A1 | | 1/2007 | Miki | |
| 2007/0078017 | A1 | * | 4/2007 | Kwon | 473/44 |
| 2009/0048032 | A1 | * | 2/2009 | Chang | 473/44 |
| 2010/0093455 | A1 | * | 4/2010 | Chang | 473/44 |

* cited by examiner

FOREIGN PATENT DOCUMENTS

KR 3005414040000 10/2009

OTHER PUBLICATIONS

English translation of Search Report for Taiwan Patent Application No. 102300326 dated Apr. 15, 2013 (1 page).

*Primary Examiner* — Mark Graham
(74) *Attorney, Agent, or Firm* — Michael Best & Friedrich LLP

(57) ABSTRACT

A pool cue shaft assembly includes a thermoplastic support body extending along a shaft axis from a tip end to a collar end. The support body defines at least three fin members extending radially from a geometric center of the support body. Spaces between the radially extending fin members define at least three longitudinal grooves. At least three inlay members are coupled to the thermoplastic support body. Each inlay member is disposed within a respective longitudinal groove and extends from the tip end to the collar end.

20 Claims, 4 Drawing Sheets

POOL CUE

CROSS REFERENCE TO RELATED APPLICATIONS

This application claims priority to U.S. Provisional Patent Application No. 61/578,659, filed Dec. 21, 2011, and to U.S. Provisional Patent Application No. 61/658,488, filed Jun. 12, 2012, the contents of which are herein incorporated by reference.

BACKGROUND

The present invention relates to pool cues. Pool cues are used in games such as billiards to strike a cue ball. The materials and construction of a pool cue can affect a player's feel of the cue.

SUMMARY

In one embodiment, the invention provides a pool cue shaft assembly. The pool cue shaft assembly includes a thermoplastic support body extending along a shaft axis from a tip end to a collar end. The support body defines at least three fin members extending radially from a geometric center of the support body. Spaces between the radially extending fin members define at least three longitudinal grooves. At least three inlay members are coupled to the thermoplastic support body. Each inlay member is disposed within a respective longitudinal groove and extends from the tip end to the collar end.

In another embodiment the invention provides a pool cue. A butt assembly includes a butt collar and a threaded shaft extending from the butt collar. A shaft assembly extends along a shaft axis from a tip end to a collar end. The shaft assembly includes a thermoplastic support body defining at least three fin members extending radially from a geometric center of the support body. Spaces between the radially extending fin members define at least three longitudinal grooves. At least three inlay members are coupled to the thermoplastic support body. Each inlay member is disposed within a respective longitudinal groove and extends from the tip end to the collar end. An insert coupled to the thermoplastic support body and the at least three inlay members at the collar end and defining a threaded aperture. The threaded aperture selectively receives the threaded shaft to detachable couple the butt assembly to the shaft assembly.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings. Recitation of ranges of values herein are merely intended to serve as a shorthand method of referring individually to each separate value falling within the range, unless otherwise indicated herein, and each separate value is incorporated into the specification as if it were individually recited herein.

Figure 1:
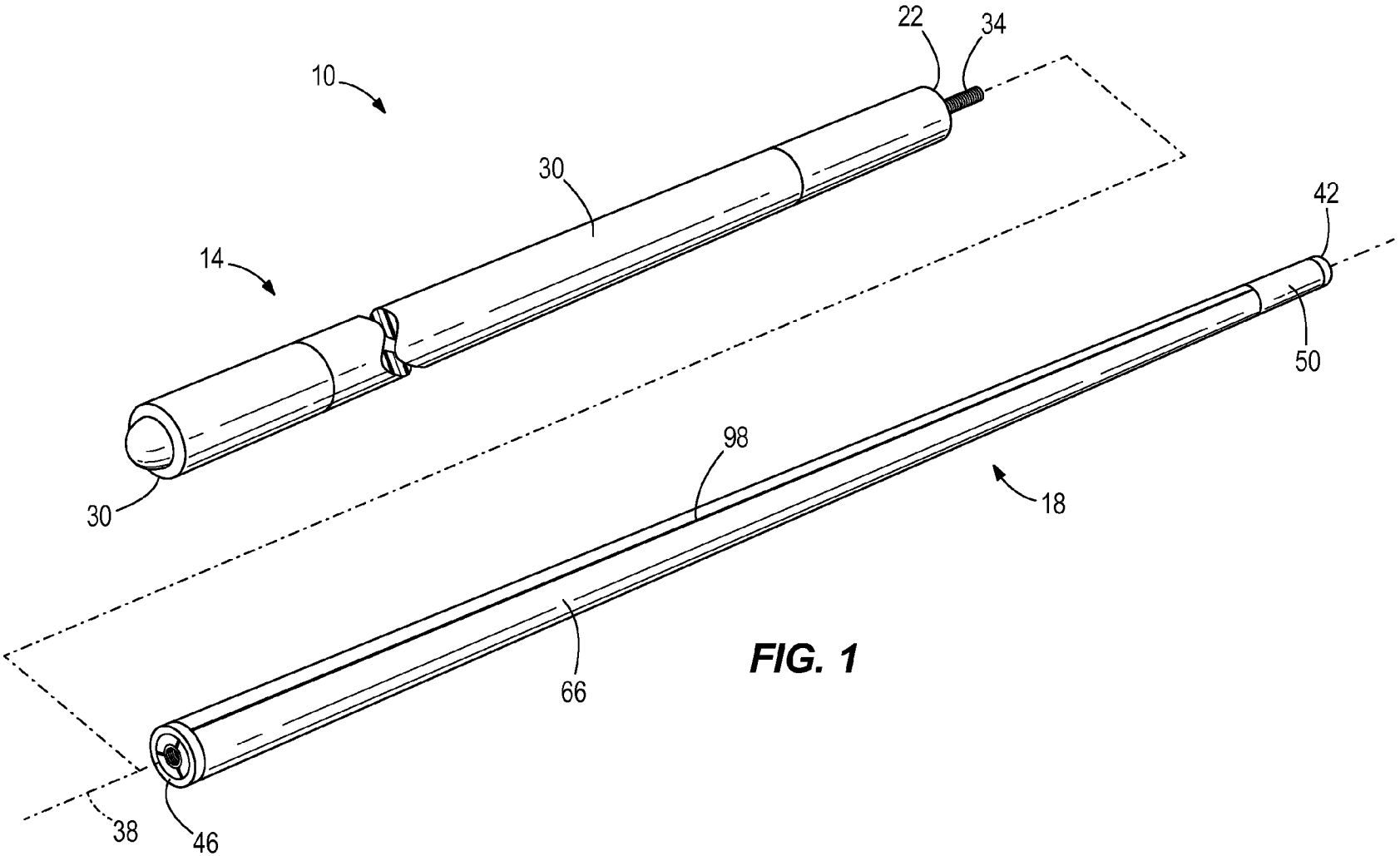
FIG. 1 is an exploded view of a pool cue assembly including a butt assembly and a shaft assembly.

Referring to FIG. 1, a pool cue assembly 10 includes a butt assembly 14 and a shaft assembly 18. The butt assembly 14 extends between a butt collar 22 and an end cap 26. A grip portion 30 is defined between the end cap 26 and the butt collar 22. A threaded shaft 34 extends from the butt collar 22.

Figure 4:
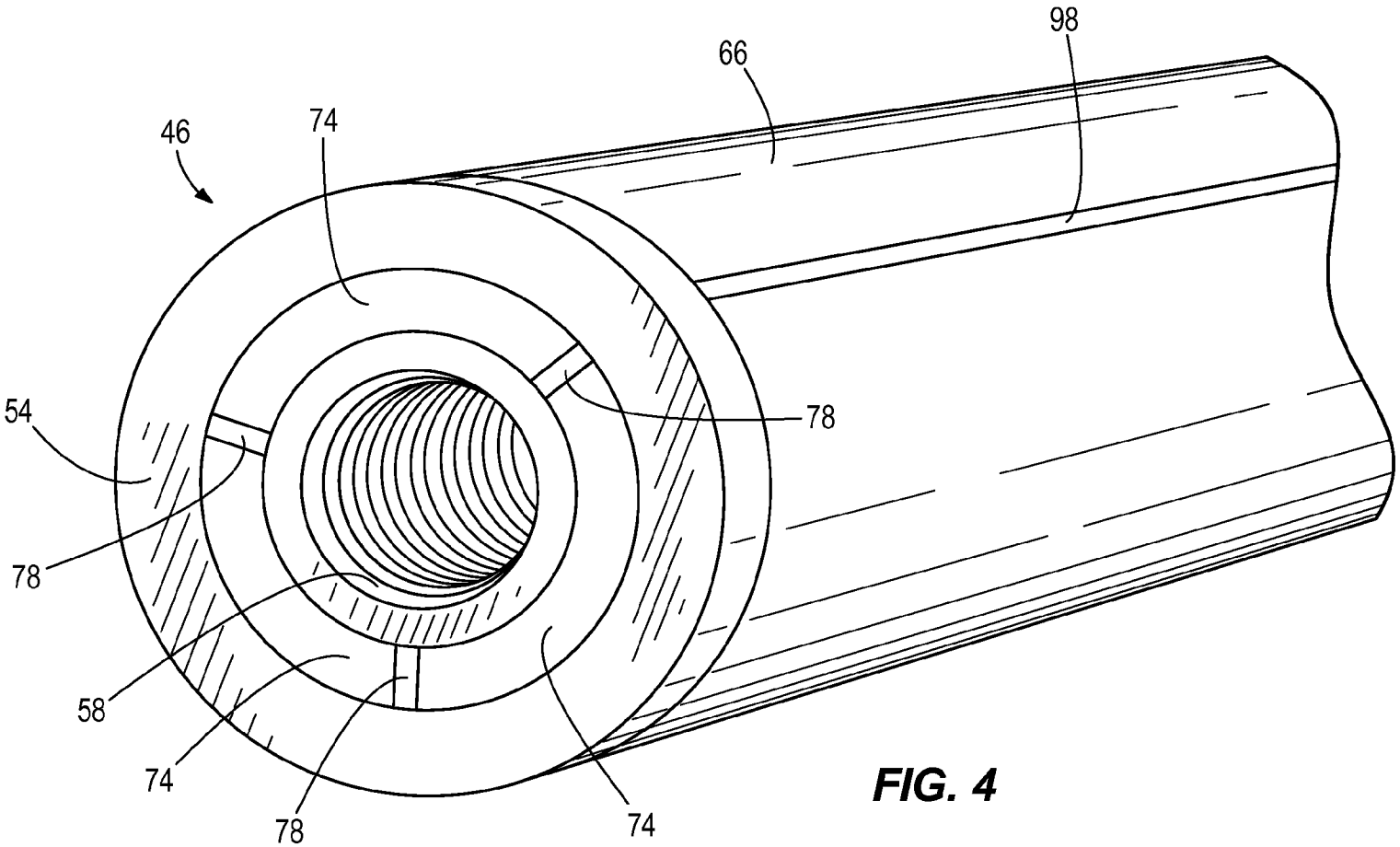
FIG. 4 is a perspective view of a collar end of the shaft assembly of FIG. 1.

The shaft assembly 18 is oriented along a shaft axis 38 and extends from a tip 42 to a shaft collar 46. The tip 42 is coupled to a ferrule 50. Referring to FIG. 4, the shaft collar 46 includes a collar washer 54 and a threaded insert 58. The threaded insert 58 is configured to receive the threaded shaft 34 (FIG. 1), thereby defining a joint of the pool cue 10. The joint is provided such that the butt assembly 14 and shaft assembly 18 may be selectively rigidly coupled and decoupled.

A shaft body 66 extends from the ferrule 50 to the shaft collar 46. The shaft body 66 tapers from a widest point adjacent the shaft collar 46 to a narrowest point adjacent the ferrule 50.

Figure 2:
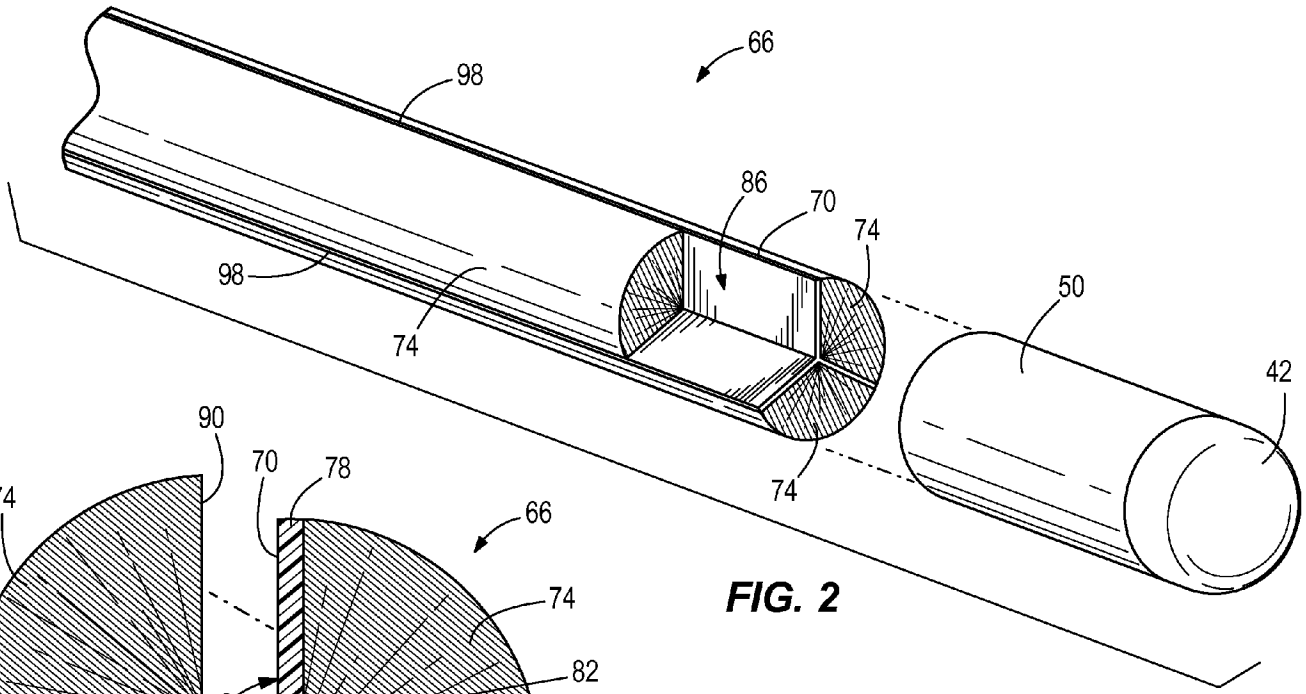
FIG. 2 is a cutaway view of the shaft assembly of FIG. 1 according to one aspect of the invention.
Figure 3:
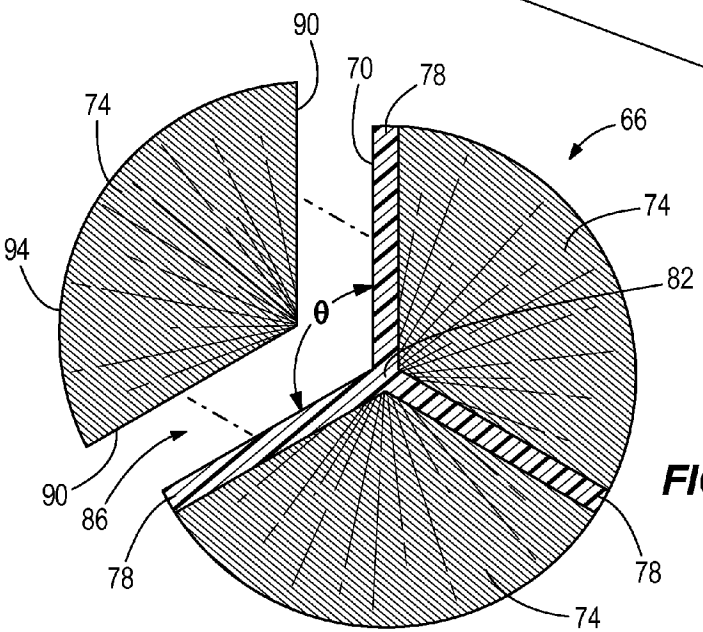
FIG. 3 is a cross-sectional view of the shaft assembly of FIG. 1

Referring to now to FIG. 2, the shaft body 66 includes a support member 70 and a plurality of inlay members 74. The support member 70 defines three fins 78 extending radially from the axis 38, such that a geometric center 82 of the support member lays 70 on the axis 38. The fins 78 are substantially evenly spaced approximately 120 degrees apart, with longitudinal grooves 86 defined between the fins 78. In other embodiments, more than three fins 78 may be used.

The support member 70 may be unitarily formed, such as by an extrusion process, of a thermoplastic, suitably the thermoplastic may be a polyvinyl chloride material, or a heat and impact resistant thermoplastic or other impact modified acrylic material. Suitably, the thermoplastic material selected may have "memory" structural properties, so it returns to a default form or structure after being bent. Furthermore, a suitable thermoplastic material may be capable to be formed to provide the fins 78 with radial consistency of the degree separation between the fins 78 for the entire length of the support member 70. The support member 70 may have a constant cross-sectional diameter when formed. Suitably, the width of the fins can be selected to be a suitable thickness. In one embodiment, the thickness is suitably between the 0.010 to 050 inches thick and in another embodiment between 0.020-0.050 inches thick.

Each inlay member 74 has a cross-section defined by two radial surfaces 90 and an arcuate surface 94. Each inlay member 74 has a central angle θ, between the radial surfaces 90, of approximately 120 degrees. Thus, each inlay member 74 is configured to lie within a longitudinal groove 86, such that the radial surfaces 90 make substantially uniform contact with the adjacent fins 78 of the support member 70. The inlay members 74 may be formed of various woods, including hard rock maple or other suitable woods. Alternatively, the inlays may be formed of various man-made materials, including plastic or composite material. The individual inlay members 74 may formed with a constant cross-sectional area.

The inlay members 74 are substantially, permanently coupled to the support member 70 with an adhesive. Suitable adhesives may include epoxy resins, cyanoacrylates, or other suitable resins. Suitably the adhesives are such that they can bind plastic support members to wood inlay members. One such adhesive is epoxy resin EP1282 from Ellsworth Adhesive company.

With the inlay members 74 permanently coupled to the support member 70, the shaft body 66 may be turned to a suitable profile with a smooth, external surface 94, such as is illustrated in FIG. 1. Once profiled, each fin 78 defines a sight-line 98 (three total or more in other embodiments equaling the number of fins 78) on the surface 94 of the shaft body 66. The sight lines 98 may be used, for example, as a cue alignment aid for improved shot accuracy. The color of the sight lines 98 is chosen to be of a suitable contrast to the color of the inlay members 74 to help distinguish the sight lines 98 from the inlay members 74. Suitable colors include, but are not limited, to black or white.

Figure 5:
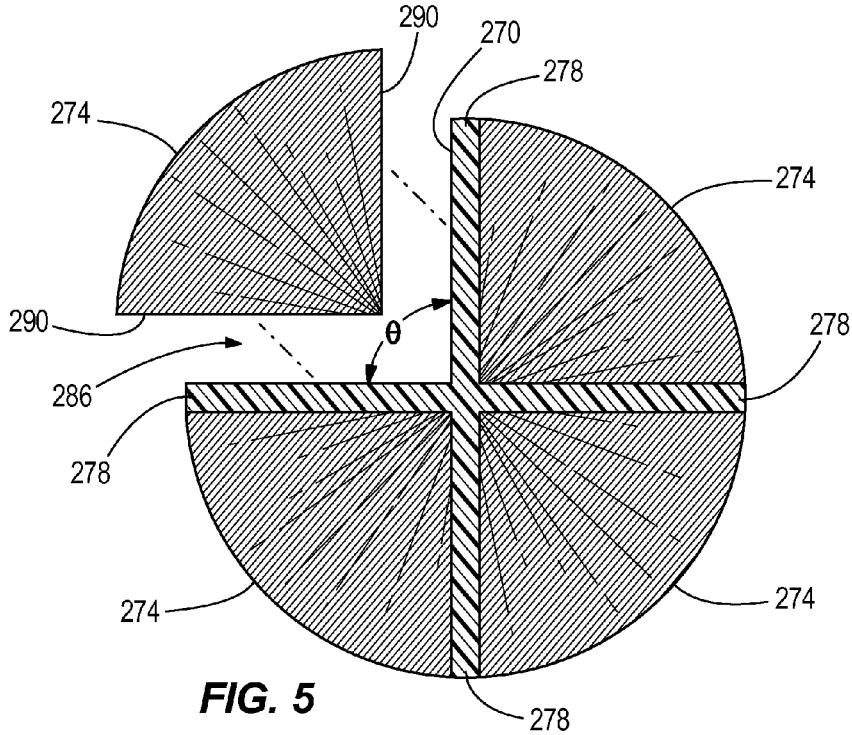
FIG. 5 is cross-sectional view of a shaft assembly according to another construction of the invention.
Figure 6:
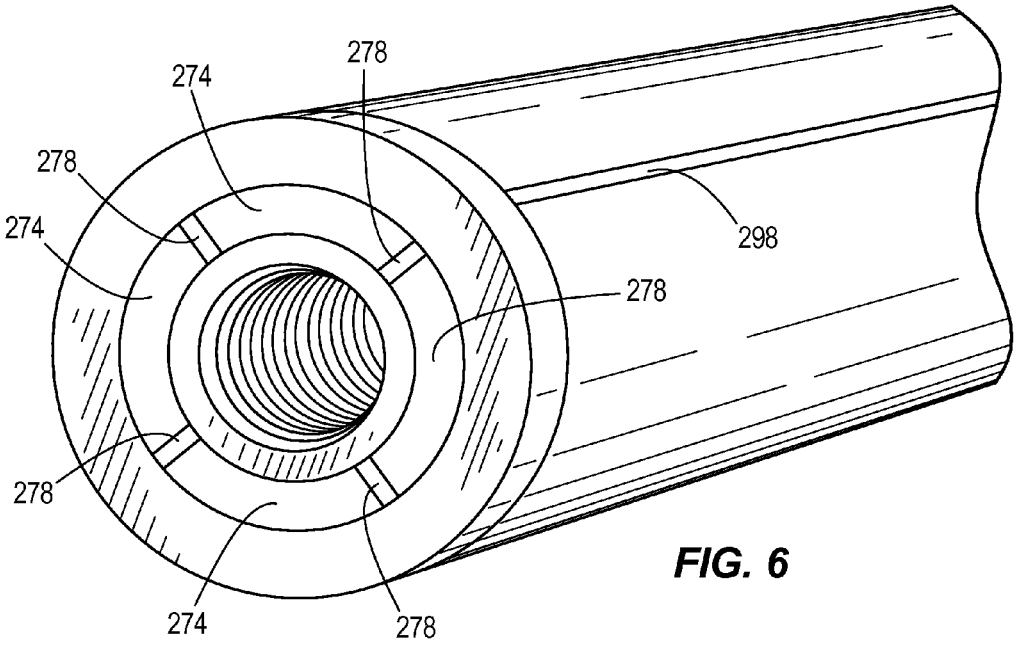
FIG. 6 is a perspective view of a collar end of the shaft assembly of FIG. 5.

FIGS. 5-7 illustrate a shaft assembly according to another construction of the invention. The shaft assembly of FIGS. 5-7 is substantially similar to that described with respect to FIGS. 1-4, and only of the differences will be described herein. Similar components to those described with respect to FIGS. 1-4 have been given the same reference number, with a "2" prefix.

In the embodiment of FIGS. 5-6, a support member 270 defines four fins 278 extending radially from an axis 238, such that a geometric center 282 of the support member 270 lies on the axis 238. The fins 278 are substantially evenly spaced approximately 90 degrees apart, with longitudinal grooves 286 defined between the fins 278. Inlay members 274 each have radial surfaces 290 defining a central angle θ of approximately 90 degrees. Thus, each inlay member 274 is configured to lie within the longitudinal grooves 286, such that the radial surfaces 290 make substantially uniform contact with the adjacent fins 278 of the support member 270. Referring to FIG. 6, the fins 278 define four sight lines 298.

The pool cue of the present invention provides beneficial stability characteristics provided, in part, by the support member 70. The cue provides a more stable shaft under impact and flex conditions. When the shaft is used to strike a billiard ball, there is less flex in the shaft. Additionally, the shaft remains true (i.e. straight) and does not maintain a curved or warped shaft after being subjected to bending or flexing forces.

Thus, the invention provides, among other things, a shaft assembly of a pool cue having beneficial characteristics. Various features and advantages of the invention are set forth in the following claims.

What is claimed is:

1. A pool cue shaft assembly, comprising:

a thermoplastic support body extending along a shaft axis from a tip end to a collar end, the support body defining at least three fin members extending radially from a geometric center of the support body, where spaces between the radially extending fin members define at least three longitudinal grooves;

at least three inlay members coupled to the thermoplastic support body, each inlay member disposed within a respective longitudinal groove and extending from the tip end to the collar end.

2. The pool cue shaft assembly of claim 1, further comprising a threaded insert coupled to the collar end.

3. The pool cue shaft assembly of claim 1, wherein the support member is unitarily formed as one piece.

4. The pool cue shaft assembly of claim 1, wherein each inlay member has a cross-section defined by two radial surfaces and an arcuate surface.

5. The pool cue shaft assembly of claim 4, wherein the radial surfaces are in substantially uniform contact with adjacent fin members of the support body.

6. The pool cue shaft assembly of claim 1, wherein the inlay members are substantially permanently bonded to the support member with an epoxy resin.

7. The pool cue shaft assembly of claim 1, wherein the support member includes four fin members defining four longitudinal grooves, and wherein four inlay members are coupled to the support member.

8. The pool cue shaft assembly of claim 1, wherein the inlay members are formed of wood.

9. The pool cue shaft assembly of claim 1, wherein an exterior surface of the pool cue shaft assembly is defined by the fin members and the inlay members.

10. The pool cue assembly of claim 9, wherein the fin members define sight lines on the exterior surface.

11. A pool cue, comprising:

a butt assembly including a butt collar and a threaded shaft extending from the butt collar;

a shaft assembly extending along a shaft axis from a tip end to a collar end and comprising:

a thermoplastic support body defining at least three fin members extending radially from a geometric center of the support body, where spaces between the radially extending fin members define at least three longitudinal grooves;

at least three inlay members coupled to the thermoplastic support body, each inlay member disposed within a respective longitudinal groove and extending from the tip end to the collar end;

an insert coupled to the thermoplastic support body and the at least three inlay members at the collar end and defining a threaded aperture, the threaded aperture selectively receiving the threaded shaft to detachable couple the butt assembly to the shaft assembly.

12. The pool cue of claim 11, wherein each inlay member has a cross-section defined by two radial surfaces and an arcuate surface.

13. The pool cue of claim 11, wherein the at least three inlay members are adhesively bonded to the thermoplastic support body.

14. The pool cue of claim 11, wherein the at least three inlay members are formed of wood.

15. The pool cue shaft assembly of claim 11, wherein an exterior surface of the pool cue shaft assembly is defined by the fin members and the inlay members.

16. The pool cue assembly of claim 15, wherein the fin members define sight lines on the exterior surface.

17. The pool cue shaft assembly of claim 11, wherein the radial surfaces are in substantially uniform contact with adjacent fin members of the support body.

18. The pool cue shaft assembly of claim 11, wherein the inlay members are substantially permanently bonded to the support member with an epoxy resin.

19. The pool cue shaft assembly of claim 11, wherein the support member includes four fin members defining four longitudinal grooves, and wherein four inlay members are coupled to the support member.

20. The pool cue shaft assembly of claim 11, wherein each inlay member extends from the tip end to the collar end.

* * * * *